US007429314B2

(12) United States Patent
Couvreur et al.

(10) Patent No.: US 7,429,314 B2
(45) Date of Patent: Sep. 30, 2008

(54) DEVICE FOR CONTROLLING THE TRAVEL DISTANCE OF A CHISEL IN A FEEDING SYSTEM FOR AN ALUMINIUM PRODUCTION ELECTROLYTIC CELL

(75) Inventors: Sebastien Couvreur, Nielles les Blequin (FR); Jerome Bos, Fontaine (FR); Silvino Caetano, Sainte Marie Kerque (FR); Christian Dreyer, Tatinghem (FR)

(73) Assignee: Aluminium Pechiney, Paris Cedex (FR)

( * ) Notice: Subject to any disclaimer, the term of this patent is extended or adjusted under 35 U.S.C. 154(b) by 199 days.

(21) Appl. No.: 11/220,905

(22) Filed: Sep. 8, 2005

(65) Prior Publication Data

US 2006/0231385 A1 Oct. 19, 2006

(30) Foreign Application Priority Data

Apr. 19, 2005 (FR) ..... 05 03877

(51) Int. Cl.
*C25C 3/14* (2006.01)

(52) U.S. Cl. ..... 204/230.5; 204/230.3; 204/230.8; 204/245; 204/247

(58) Field of Classification Search ..... 204/245, 204/247, 230.3, 230.5, 230.8; 91/27, 28, 91/32, 33, 169, 217, 275, 346, 403, 448
See application file for complete search history.

(56) References Cited

U.S. PATENT DOCUMENTS 4,700,612 A * 10/1987 Pfister ..... 91/471
5,899,753 A 5/1999 Wong
6,436,270 B1 * 8/2002 Sander ..... 205/336
2004/0213323 A1 * 10/2004 Benjamin ..... 374/179

FOREIGN PATENT DOCUMENTS

DE 20 2004 008474 U 9/2004

* cited by examiner

*Primary Examiner*—Bruce F Bell
(74) *Attorney, Agent, or Firm*—Dennison, Schultz & MacDonald

(57) ABSTRACT

Device for equipment of a cell (1) comprising an electrolytic bath (4) covered with a crust (5), with a chisel (13) that can be moved vertically between a high position in which it is above the crust (5) and a low position in which the crust (5) is perforated and in which contact is made with the bath (4), the device (11) comprising means of detecting electrical contact between the chisel (13) and the bath (4), these means comprising an electrical circuit (19) capable of making an electrical measurement between the chisel (13) and a point (20) in the cell used as an electrical reference, and taking immediate action on the actuator to cause vertical upwards displacement of the chisel when a predetermined value of an electrical measurement is reached. The electrical circuit (19) is connected to the chisel (13), to the rod (14) of the chisel (13) or to the actuator rod (17) through connecting means capable of creating a point contact (24) at least one point between the circuit (19) and the chisel (13), the rod (14) of the chisel (13) or the actuator rod, these connecting means (23) being acted upon by elastic means (25) pushing them towards the chisel (13), the rod (14) of the chisel (13) or the actuator rod (17) respectively.

16 Claims, 3 Drawing Sheets

DEVICE FOR CONTROLLING THE TRAVEL DISTANCE OF A CHISEL IN A FEEDING SYSTEM FOR AN ALUMINIUM PRODUCTION ELECTROLYTIC CELL

BACKGROUND OF THE INVENTION

This invention relates to a device for controlling the travel distance of a chisel for a point feed system for an electrolytic cell designed for aluminum production.

The units usually used enable the addition of alumina and/or electrolyte to one or several feed points per cell; these products are added into the electrolytic bath through a hole made by a crust breaker that is lowered periodically and breaks the crust or keeps the hole open.

The travel distance of the crust breaker is normally equal to a fixed length determined by the mechanical system that moves it vertically.

This type of device has disadvantages. Depending on the hardness of the crust and the level of the free surface of the electrolyte, it sometimes occurs that the travel distance of the crust breaker is too short to break the crust so that alumina can be added. On the contrary, if this travel distance is too great, it is possible that the active end of the crust breaker, also called the chisel, remains in the electrolytic bath for too long. It has also been observed that the chisel can penetrate deeply into the electrolyte. In this case, the chisel carries part of the solidified bath with it in the form of a deposit that increases every time that the crust breaker is lowered. Prolonged contact between the chisel and the electrolyte degrades the chisel due to the high temperature and the chemically aggressive nature of the bath.

Furthermore, since the chisel is guided by a sheath, the solidified bath deposit on the chisel may form an accumulation despite the presence of a scraper that could make it impossible for the chisel to rise all the way up in the sheath. The result can be that the chisel gets blocked in the device, causing closure of the alumina feed and/or electrolyte feed hole.

This jamming and blocking phenomenon can also cause the chisel to break and/or wear, mechanical shocks due to the increase in tension of the jack controlling the crust breaker movement, and degradation of the material used as electrical insulation due to thermal shocks and lateral forces that occur when the solidified bath comes into contact with the scraper. The device can then no longer function.

It is also difficult to control penetration of the chisel into the electrolyte due to the variation of the electrolyte level, particularly resulting from operations carried out on the pot and variations in the distance between the anodes and the metal caused particularly by regulation of the resistance of the electrolytic cell.

Feeding means to supply alumina to an electrolytic cell producing aluminum, particularly according to the Hall-Héroult process, have been described in documents FR 2 483 965, FR 2 614 320, U.S. Pat. No. 4,563,255 and WO 0106039.

Documents FR 2 483 965 and WO 0106039 each describe a device used to create an electrical contact to raise the chisel when it comes into contact with the electrolyte. However, these documents do not describe any means of establishing such a contact.

Document U.S. Pat. No. 4,563,255 describes a device of the same type as the above, more specifically related to the structure of the electrical circuit for detection of contact between the chisel and the electrolyte, but does not indicate any precise means for creating contact on the chisel, since this contact is simply diagrammatically shown at the crust breaker actuation jack.

Document FR 2 614 320 divulges how to detect contact between the chisel and the electrolytic bath by means of an electrical circuit connected the chisel rod to the cathode substrate. However, in this document the electrical circuit is connected to the chisel rod through an electrical contact subject to friction that can fluctuate; such a sliding contact cannot reliably close the electrical contact on the chisel rod. Consequently, contact between the chisel and the electrolytic bath is not detected with certainty and in good time, and the chisel can remain immersed in the electrolytic bath for longer than necessary, causing the clogging phenomenon mentioned above.

SUMMARY OF THE INVENTION

This invention is intended to overcome these problems by proposing a device for particularly close control of the travel distance of the chisel so as to precisely detect the time of contact between the chisel and the bath, due to setting up a very reliable electrical contact between the electrical circuit and the chisel.

The purpose of this invention is a device for controlling the travel distance of a chisel in a feeding system of an electrolytic cell intended for aluminum production, the said cell comprising an electrolytic bath covered with a crust, the chisel being carried by a rod fixed to the rod of an actuator that vertically displaces the chisel between a high position in which it is above the crust and a low position in which the crust is perforated and in which contact is made with the bath, the device comprising means of detecting electrical contact between the chisel and the bath, these means comprising an electrical circuit capable of making an electrical measurement between the chisel and a point in the cell used as an electrical reference, and taking immediate action on the actuator to cause vertical upwards displacement of the chisel when a predetermined value of an electrical measurement is reached, characterised in that the said electrical circuit is connected to the chisel, to the chisel rod or to the actuator rod through connecting means capable of creating a point contact at least one point between the circuit and the chisel, the chisel rod or the actuator rod, these connecting means being acted upon by elastic means pushing them towards the chisel, the chisel rod or the actuator rod respectively.

The device according to the invention is capable of making an electrical measurement such as a voltage measurement or a current measurement between the chisel, the chisel rod or the actuator rod and the bath in a particularly reliable and precise manner. Electrical contact can be created with only one of these parts, while having a sufficient measurement quality. The electrical contact is preferably created on the chisel or on the chisel rod, since these parts are firmly assembled to each other with excellent electrical continuity. Thus, since the contact set up between the electrical circuit and one of the above mentioned parts is applied at a point and is particularly reliable due to the force applied by the elastic means, it is possible to take immediate action on the actuator controlling the travel distance of the chisel to make it rise to a high position and to prevent it from remaining immersed in the electrolytic bath for too long. This prevents solidified bath deposit from accumulating on this chisel and causing the clogging and blocking phenomena mentioned above. Therefore, the increase in the mechanical tension on the actuator and the resulting mechanical shocks are avoided. And finally, risks of the chisel breaking and being worn are considerably reduced, and the corresponding thermal forces and degradations of peripheral materials such as insulating materials are also reduced.

In one preferred embodiment of the invention, the connecting means are in the form of a part made of conducting material for which the section reduces in the direction of the contact with the chisel rod, the said part being acted upon by the action of the said elastic means.

Thus, due to the special shape of the part made of a conducting material, the contact between the electrical circuit and the chisel, the chisel rod or the actuator rod is basically point like.

According to one embodiment, the part made of a conducting material has a spherical bearing head, such as a ball or a nose cone with a spherical end.

According to another embodiment, the connecting means are in the form of a cylinder with an axis forming an angle (preferably a right angle) with the axis of the chisel, the chisel rod or the actuator rod.

According to yet another embodiment, the connecting means are in the form of a part in the general shape of a diabolo comprising a recess delimited by two convergent convex surfaces that can bear on two points on the chisel, the chisel rod or the actuator rod.

Advantageously, the connecting means are both in the form of a metallic part such as steel or copper, or a non-metallic conducting part such as silicon carbide. The resulting electrical contact is particularly reliable. Furthermore, a material such as steel is particularly resistant to high temperatures and the corrosive atmosphere above the electrolytic bath.

Preferably, the part made of a conducting material has a Brinell hardness of between 285 and 370, measured with a tungsten carbide ball under a weight of 3000 kg, corresponding to a Rockwell hardness of 30 to 40 HRC. This is sufficiently hard to prevent damage to the chisel rod, while providing an efficient electrical contact.

Advantageously, the elastic means are in the form of a helical spring. Preferably, this spring applies a force of 50 N or less. The resulting contact between the electrical circuit and the chisel rod is thus particularly reliable, while preventing wear of the chisel rod.

In one preferred embodiment of the invention, the part made of a conducting material and the helical spring are mounted inside a socket made of a conducting material, the part made of a conducting material projecting from one end of the socket and the end of the socket opposite the ball being provided with a contact means.

Also preferably, the socket is screwed into a threaded hole formed in the wall of a sheath surrounding the rod. This arrangement enables easy assembly, easy replacement in case of wear or damage, and an adjustment of the pressure applied by the part made of a conducting material on the chisel, the chisel rod or the actuator rod, as a function of the extent to which the socket is screwed into the threaded hole of the sheath. This arrangement means that only minor modifications are necessary to be able to equip existing crustbreaking devices. The part made of a conducting material is thus held firmly in reliable contact with the chisel, the chisel rod or the actuator rod.

Advantageously, the device according to the invention comprises two parts made of a conducting material arranged facing each other, bearing on the chisel, the chisel rod or the actuator rod, on each side of it. In this case, the reliability of the electrical contact is optimum. Furthermore, the opposing forces of the two sockets cancel out and prevent deviation of the rod.

In one preferred embodiment of the invention, the point on the cell used as a reference is located on the cathode.

BRIEF DESCRIPTION OF THE DRAWINGS

The invention will be better understood after reading the following description given with reference to the attached diagrammatic drawing in which.

DESCRIPTION OF THE PREFERRED EMBODIMENTS

Figure 1:
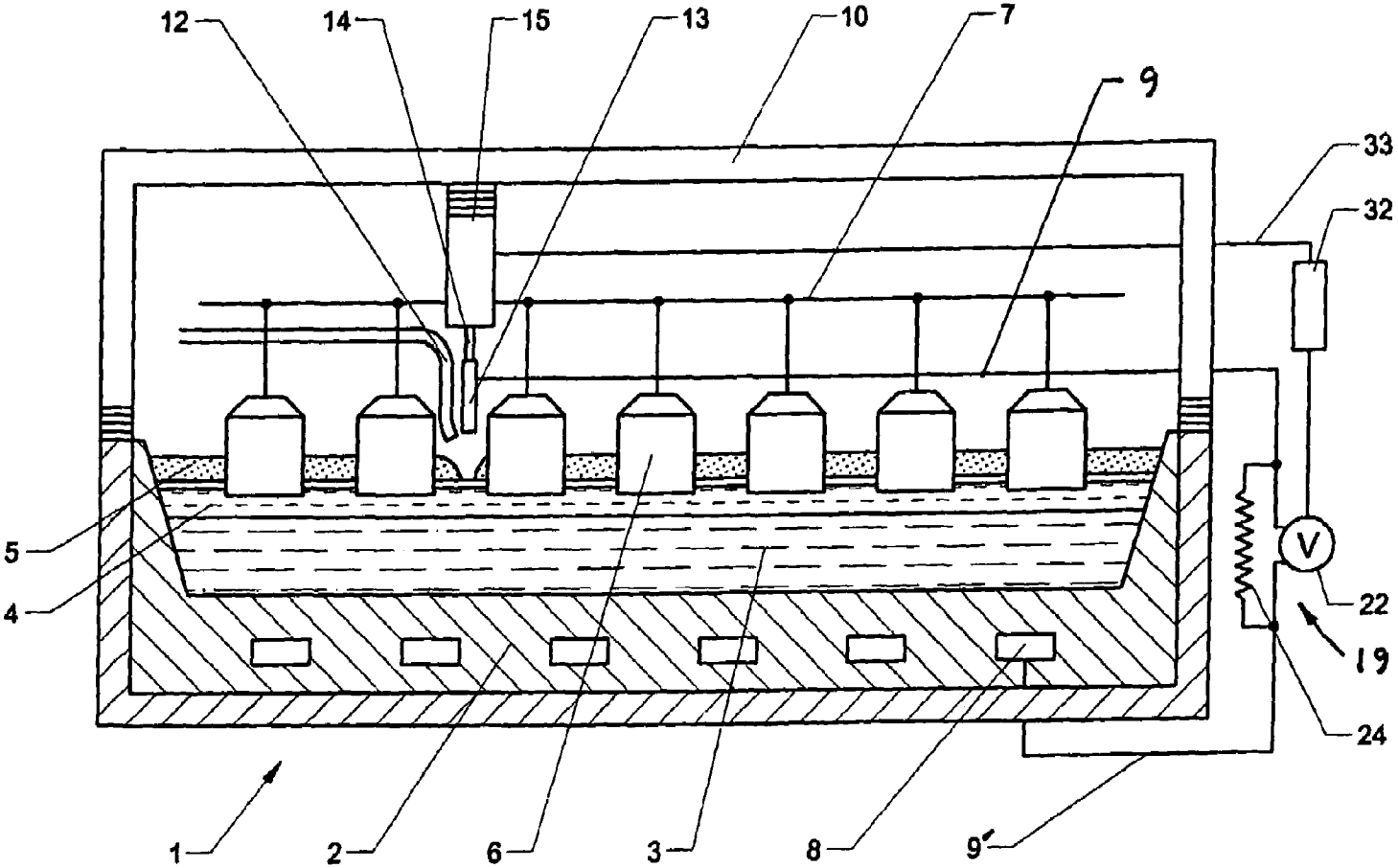
FIG. 1 is a diagrammatic sectional view of an electrolytic cell designed to produce aluminum using the Hall-Héroult process.

FIG. 1 shows an electrolytic cell 1 intended for aluminum production using the Hall-Héroult process. This cell 1 comprises a cathode 2 formed of several cathode blocks, a molten aluminum bath 3, a molten electrolytic bath 4 above which there is a crust 5 formed from a solid electrolyte and alumina, anodes 6 dipping into the electrolyte, a positive bar 7 that distributes electrical current to the anodes, cathode bars 8 sealed in the cathode blocks 2 and that carry electrical current output from the cathode 2, a least one negative bar that collects current from the cathode bars 8 and a superstructure 10 on which the control device according to the invention is typically fixed, shown diagrammatically in this Figure adjacent to an alumina and/or electrolyte feeding system 12.

Figure 2:
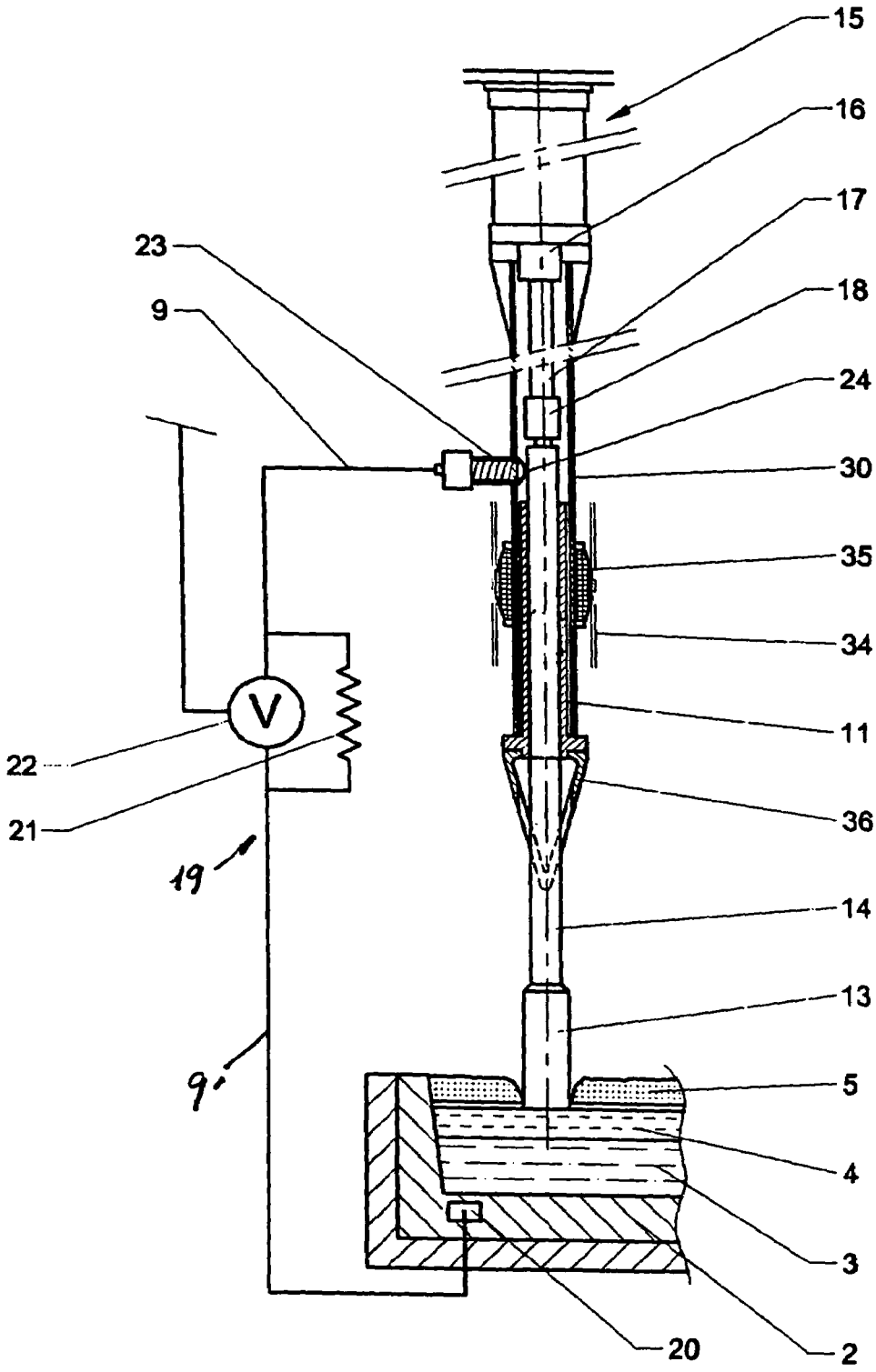
FIG. 2 shows a sectional view of the crust breaker device equipped with an embodiment of the device according to the invention, in which the chisel is in a low position.

As shown in FIG. 2, the installation comprises a chisel 13 supported by a rod 14. The chisel 13 may be fixed to the rod 14, for example by screwing, or it may form a single part with the rod 14. This chisel 13 is movable vertically between a high position (see FIG. 3) in which it is above the crust 5 and a low position in which it has perforated the crust and comes into contact with the electrolytic bath 4 as shown in this figure. The upwards or downwards vertical movement of the chisel 13 is controlled by an actuator, in this case formed of a double acting jack 15 provided with a piston 16 in which the rod 17 is connected to the rod 14 of the chisel 13 using a connecting device 18.

The rod 14 is installed inside a sheath 30, inside which there is a guide sleeve 11. A tube 34 is arranged outside the sheath 30, and elements 35 forming electrical insulations are interposed. A scraper element 36 is installed at the end of the sheath 30.

The control device comprises means of detecting electrical contact between the chisel 13 and the electrolytic bath 4 in the form of an electrical circuit 19 that can measure the electrical voltage between the chisel 13 and a point 20 in the cell used as a reference potential, this point 20 being located on the cathode 2 in this Figure. This electrical circuit 19 typically comprises a resistance 21, a voltmeter 22 and connecting conductors 9, 9'.

According to the invention, the measurement circuit 19 is connected to the jack rod 17, or to the rod 14 onto which the chisel is fixed, or to the chisel 13 through connecting means 23 capable of creating a reliable and point contact 24 between the circuit 19 and the said rods or chisel. FIG. 2 illustrates a preferred embodiment in which the said point contact is located on the rod 14 carrying the chisel.

Figure 4:
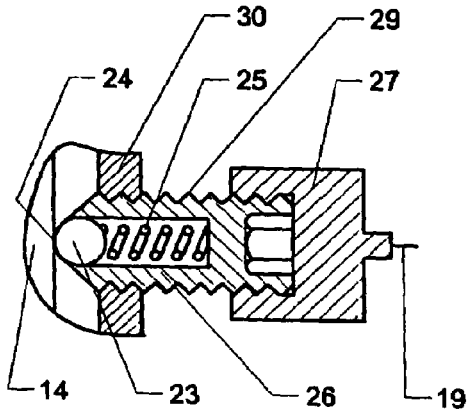
FIG. 4 shows a larger scale sectional view showing the socket of the device according to a preferred embodiment of the device according to the invention.

As can be seen more clearly in FIG. 4, the connecting means 23 may be in the form of a metallic part, typically steel, for which the section becomes smaller towards the contact 24 with the rod 14 of the chisel 13, particularly in the form of a ball as shown in this Figure, and subjected to action by elastic means 25 shown in the form of a helical spring in this Figure, pushing them towards the rod 14 of the chisel 13.

As shown in FIG. 4, the ball 23 and the spring 25 may be mounted inside a socket 26 made of a conducting material such as steel or copper, for which the end opposite the ball is equipped with a contact means 27. The socket 26 has an external thread 29 and is thus screwed into a threaded hole formed in the wall of the sheath 30 surrounding the rod 14. The socket is thus firmly fixed facing the rod 14 and the contact 24 created between the ball 23 and the rod 14 is particularly reliable and constant.

Figure 3:
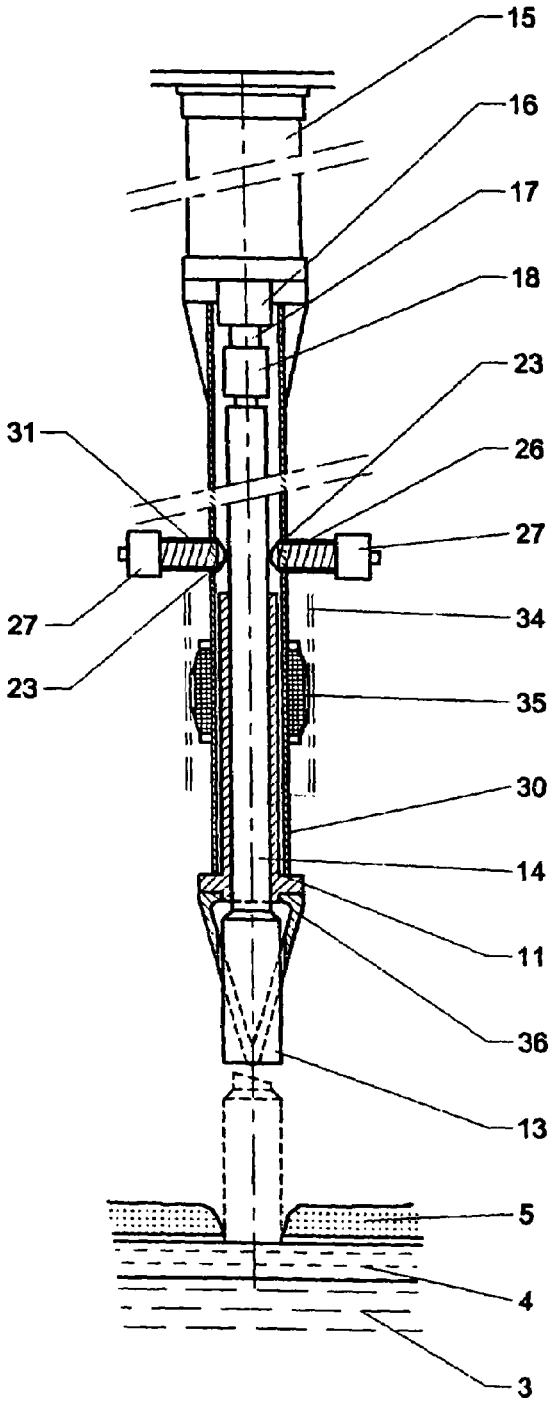
FIG. 3 is a partial sectional view of the crust breaker device equipped with an embodiment of the device according to the invention, in which the chisel is in a high position.

FIG. 3 shows a part of a device according to the invention in which the chisel 13 is in a high position, the low position being shown in chain dotted lines. In this Figure, a second socket 31 also comprising a ball and a helical spring is screwed into the sheath 30 surrounding the rod 14 of the chisel 13 facing the first socket 26. Thus, opposing forces applied by the socket 26 and the socket 31 cancel each other out and prevent deviation of the rod 14.

Thus during operation, the chisel 13 drops from its high position towards the crust 5 and the electrolytic bath 4, under the action of the jack 15. As it descends, the ball is in reliable contact with the mobile rod 14 of the chisel 13 due to the elastic means 23 that push it towards the rod 14. At this moment, the voltmeter does not detect any significant voltage since the circuit 19 is not closed. When the chisel 13 has perforated the crust 5 and comes into contact with the electrolytic bath 4, the voltmeter 22 detects that a voltage threshold has been exceeded due to the point contact 24 between the measurement circuit 19 and the rod 14 through the ball 23. It is then possible to take immediate action on the usually pneumatic actuation mechanism of the jack 15 through a control device 32 and through a line 33, so as to raise the chisel 13. Thus, the chisel only remains in contact with or immersed in the electrolytic bath 4 for an extremely short time.

Thus, the device according to the invention can prevent repeated deposits of solidified bath on the chisel and the resulting clogging and blocking phenomena, and provides an indisputable advantage over control devices according to prior art.

Obviously, the invention is not limited to the single embodiment of the control device described above as an example, and it includes all variants of it.

Thus in particular, it is possible to detect contact between the chisel and the bath using another electrical measurement such as a current measurement.

The invention claimed is:

1. Device for controlling the travel distance of a chisel for a feeding system of an electrolytic cell for aluminum production, the cell containing an electrolytic bath covered with a crust, where the chisel is carried by a rod fixed to a rod of an actuator controlling vertical displacement of the chisel between a high position in which it is above the crust and a low position in which the crust is perforated and in which contact is made with the bath, the device comprising:

an electrical circuit comprising means for measuring an electrical parameter between the chisel and a point in the cell used as an electrical reference;

a first connection means for electrically connecting the circuit and the chisel;

a second connection means for electrically connecting the circuit and the point in the cell; and means for causing the actuator to provide immediate vertical upwards displacement of the chisel when a predetermined value of the electrical parameter is measured, indicating that the chisel is in contact with the bath;

wherein the first connection means comprises a conducting part, in electrical connection with the circuit, and means for elastically urging the conducting part into direct mechanical contact with at least one point on the chisel, the rod of the chisel or the actuator rod, resulting thereby in a point contact with the chisel, the chisel rod or the actuator rod.

2. Device according to claim 1, wherein the conducting part has a section which reduces in the direction of the contact with the chisel, the rod of the chisel or the actuator rod, the part being affected by the action of the elastic means.

3. Device according to claim 2, wherein the conducting part comprises a spherical bearing head.

4. Device according to claim 3, wherein the spherical bearing head comprises a ball or a nose cone with a spherical end.

5. Device according to claim 2, wherein the conducting part is in the form of a cylinder with an axis forming an angle with an axis of the chisel, the chisel rod or the actuator rod.

6. Device according to claim 2, wherein the conducting part is in the form of a part in the shape of a diabolo comprising a recess delimited by two convergent convex surfaces constructed and arranged to bear on two points on the chisel, the chisel rod or the actuator rod.

7. Device according to claim 2, wherein the conducting part and the urging means are mounted inside a socket made of a conducting material, the conducting part projecting from one end of the socket and an opposite end of the socket being provided with a third connection means for connecting the opposite end to the circuit.

8. Device according to claim 7, wherein the socket comprises an external thread.

9. Device according to claim 8, wherein the socket is screwed into a threaded hole formed in a wall of a sheath surrounding the rod.

10. Device according to claim 2, wherein the conducting part has a Brinell hardness of between 285 and 370.

11. Device according to claim 2, comprising two conducting parts arranged facing each other, bearing on the chisel, the chisel rod or the actuator rod, on opposite sides thereof.

12. Device according to claim 1, wherein the conducting part comprises a metallic part comprising steel or copper, or non-metallic conducting part comprising silicon carbide.

13. Device according to claim 1, wherein the urging means comprises a helical spring.

14. Device according to claim 13, wherein the spring applies a force of 50 N or less.

15. Device for breaking a crust covering a bath in an electrolytic cell for aluminum production, comprising:

a chisel carried by a chisel rod;

an actuator rod to which the chisel rod carrying the chisel is fixed;

means for controlling vertical displacement of the chisel between a high position in which the chisel is above the crust and a low position in which the crust is perforated by the chisel and in which contact is made between the chisel and the bath, the means for controlling being connected to the actuator rod;

an electrical circuit comprising means for measuring an electrical parameter between the chisel and a point in the cell used as an electrical reference;

a first connection means for electrically connecting the circuit and the chisel;

a second connection means for electrically connecting the circuit and the point in the cell; and means for causing the actuator rod to provide immediate vertical upwards displacement of the chisel when a predetermined value of the electrical measurement is reached, indicating that the chisel is in contact with the bath;

wherein the first connection means comprises a conducting part, in electrical connection with the circuit and means for elastically urging the conducting part into direct mechanical contact with at least one point on the chisel, the chisel rod or the actuator rod, resulting thereby in a point contact with the the chisel, the chisel rod or the actuator rod.

16. In combination, a cell for electrolytic production of aluminum containing a bath covered by a crust; and a device for breaking the crust covering the bath, comprising:

a chisel carried by a chisel rod;

an actuator rod to which the chisel rod carrying the chisel is fixed;

means for controlling vertical displacement of the chisel between a high position in which the chisel is above the crust and a low position in which the crust is perforated by the chisel and in which contact is made between the chisel and the bath, the means for controlling being connected to the actuator rod;

an electrical circuit comprising means for measuring an electrical parameter between the chisel and a point in the cell used as an electrical reference;

a first connection means between the circuit and the chisel;

a second connection means between the circuit and the point in the cell; and means for causing the actuator rod to provide immediate vertical upwards displacement of the chisel when a predetermined value of the electrical measurement is reached, indicating that the chisel is in contact with the bath;

wherein the first connection means comprises a conducting part, in electrical connection with the circuit and means for elastically urging the conducting part into direct mechanical contact with at least one point on the chisel, the chisel rod or the actuator rod, resulting thereby in a point contact with the chisel, the chisel rod or the actuator rod.

* * * * *